United States Patent [19]

Konvalin

[11] 4,389,309

[45] Jun. 21, 1983

[54] HEAVY METALS SEPARATOR

[76] Inventor: Laurence H. Konvalin, 7722 Vineyard Rd., Sacramento, Calif. 95823

[21] Appl. No.: 317,536

[22] Filed: Nov. 2, 1981

[51] Int. Cl.[3] ..... B03B 5/02

[52] U.S. Cl. ..... 209/465

[58] Field of Search ..... 209/465

[56] References Cited

U.S. PATENT DOCUMENTS

| | | | |
|---|---|---|---|
| 327,766 | 10/1885 | Coleman | 209/465 |
| 399,658 | 3/1889 | Emmons | 209/465 |
| 480,301 | 8/1892 | Walker | 209/465 |
| 785,819 | 3/1905 | Michaelsen | 209/465 |
| 871,546 | 11/1907 | Wilkie | 209/465 |
| 1,125,631 | 1/1915 | Anderson | 209/465 |
| 1,192,806 | 7/1916 | Weigand | 209/465 |
| 1,422,736 | 7/1922 | Brown | 209/465 |
| 2,731,148 | 1/1956 | Harvengt | 209/465 |

*Primary Examiner*—Tim R. Miles

[57] ABSTRACT

A heavy metal separator, including a rotatable paddle inside a tank receiving placer ore, and a discharge tube and a discharge pipe at the bottom of the tank, the tube serving to carry off the heavy metal, while the pipe carries off the remaining ore fragments.

1 Claim, 3 Drawing Figures

HEAVY METALS SEPARATOR

This invention relates generally to ore refining equipment. More specifically, it relates to apparatus that separates gold particles from loose gravel and sand.

It is well known that, in placer mining, the gold particles are refined from the gravel and sand ore by generally sluicing the ore over a series of riffles, so that the heavy gold particles are caught behind the riffles, while the lighter weight gravel and sand flows away across the top of the riffles. This method has been practiced for hundreds of years, and is in need of modernization, so as to be made more efficient.

A principal object of the present invention is to provide a means of refining placer gold from ore more efficiently, by employing an apparatus that operates on a centripetal force.

Another object is to provide a heavy metals separator apparatus, which may be made in any desired size, and which may be powered either manually or else by a driving engine or motor.

Other objects of the present invention are to provide a heavy metals separator apparatus, which is simple in design, inexpensive to manufacture, rugged in construction, easy to use and efficient in operation.

These, and other objects, will be readily evident, upon a study of the following specification, and the accompanying drawing, wherein.

Figure 1:
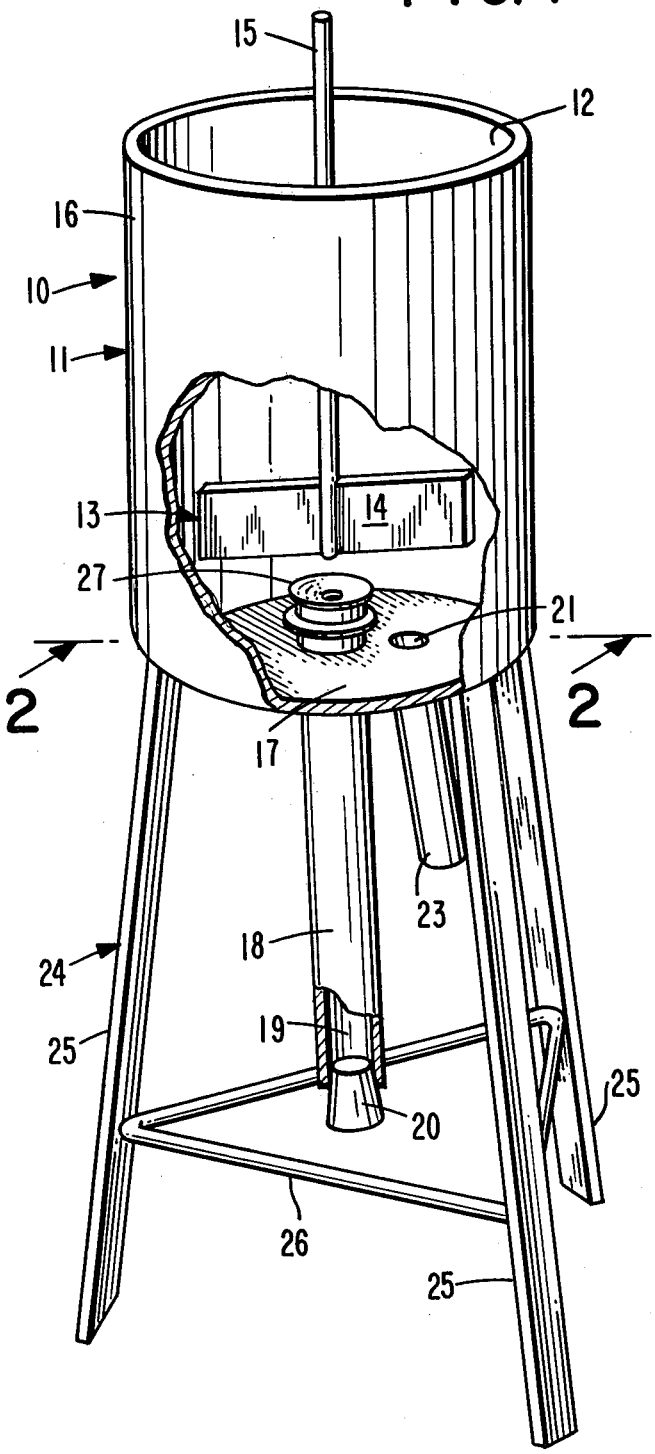
FIG. 1 is a perspective view of the invention, shown with its case broken open, so as to illustrate the interior construction.
Figure 2:
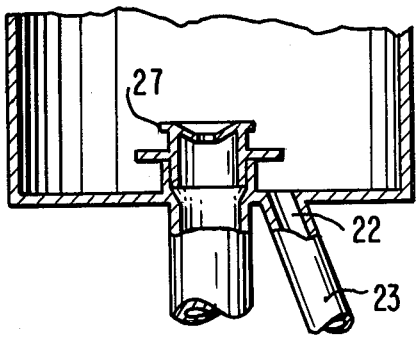
FIG. 2 is a fragmentary cross-sectional view thereof, taken on line 2—2 of FIG. 1.
Figure 3:
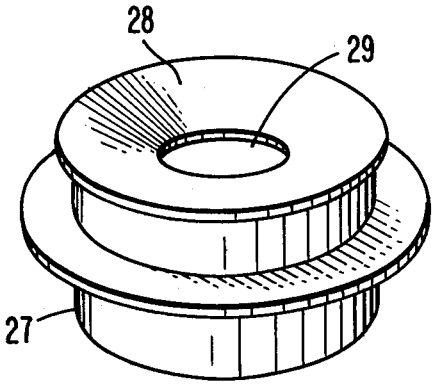
FIG. 3 is an enlarged perspective view of a restrictor component of the device.

Referring now to the drawing in greater detail, the reference numeral 10 represents a heavy metals separator, according to the present invention, wherein there is a container or tank 11 of cylindrical shape, and which has an opening 12 at its top, so that ore may be placed therein, together with water. An impeller 13, inside the tank, consists of a flat blade 14, affixed on a vertical shaft 15, which is either manually or mechanically rotated.

The tank is made of a cylindrical side wall 16, and a horizontal bottom wall 17, from a center of which a sand and gravel collector pipe 18 extends downwardly, having a central passage 19 therethrough. A dump valve 20 is removably fitted on a lower end of the pipe.

An opening 21, in the bottom wall 16, communicates with a passage 22 through a narrow diameter inclined tube 23, and which serves for a metal, such as gold, to be drawn off from a lower end thereof.

The tank is mounted upon a frame 24, that includes three downwardly spreading legs 25 and a brace 26 therebetween.

Within the tank, a restrictor 27 is installed upon an upper protruding end of the pipe 18.

If wished, a removable screen mesh, (not shown) may additionally be placed upon the bottom wall, for preventing the mixing sand and gravel from picking up any gold that settles in the screen mesh openings. The mesh would cover the entire bottom wall, and would have a central opening, so that the restrictor and pipe 18 would fit therethrough. The restrictor includes a funnel-shaped top wall 28 around a small discharge hole 29.

In operative use, the placer ore, comprising gravel, sand and gold particles, is dropped down into the tank, and the impeller is rotated so as to stir the ore, while, additionally, water also may be flushed into the tank. The gold particles will thus separate from the remainder of the ore, and fall down upon the bottom wall 17 by this centripetal action, after which, the dump valve 20 is removed from the pipe 18, and the remaining ore of sand and gravel is flushed out of the tank, through the restrictor and pipe 18. Subsequently, the collected gold particles are flushed out of the narrow tube 23.

While various changes may be made in the detail construction, it is understood that such changes will be within the spirit and scope of the present invention, as is defined by the appended claims.

What is claimed as new is:

1. A heavy metals separator, comprising, in combination, an upright, cylindrical tank containing a rotatable impeller about a vertical shaft for producing a centripetal action force on placer ore placed into said tank, and means to collect heavy metal particles from said ore while a remainder of said ore is flushed out from said tank; said means comprising a sand and gravel collector pipe under the center of said impeller and extending downward through a bottom wall of said tank, an upper end of said sand and gravel collector pipe extending upwardly of said bottom wall and being fitted with a restrictor, while a downward tube also through said bottom wall collects said heavy metal particles, an upper end of said tube being flush with said bottom wall, and a removable mesh placed upon said bottom wall.

* * * * *